United States Patent [19]

Rietz

[11] 4,400,831

[45] Aug. 30, 1983

[54] GLOVE ARRANGEMENT FOR WATER SKIING

[76] Inventor: Peter W. Rietz, Box 824, Georgetown, Colo. 80444

[21] Appl. No.: 342,753

[22] Filed: Jan. 26, 1982

[51] Int. Cl.[3] ..... A41D 19/00; A63B 53/14

[52] U.S. Cl. ..... 2/161 A; 273/166; 441/68

[58] Field of Search ..... 2/16, 161 A, 158, 20, 2/159, 161 R; 273/166, 54 B; 280/11.37 H, 11.37 D

[56] References Cited

U.S. PATENT DOCUMENTS

| | | | |
|---|---|---|---|
| 4,000,903 | 1/1977 | Swanson | 273/166 |
| 4,081,864 | 4/1978 | Liman | 2/161 A |
| 4,329,741 | 5/1982 | Bach | 2/161 A |

*Primary Examiner*—Doris L. Troutman

*Attorney, Agent, or Firm*—McWilliams, Mann, Zummer & Sweeney; McWilliams, Mann, Zummer & Sweeney

[57] ABSTRACT

A glove arrangement for water skiing for enabling the water skier to establish through his grip on the tow rope crossbar handle a finger controlled structural purchase that couples, through the glove arrangment, the skeletal structure of his arms to the tow rope handle in bypassing relation to the muscles of his hands and forearms, in which the glove for each hand is a hand cover of the usual finger glove configuration and includes a palm portion and a wrist portion in which a palm side strapping is affixed to the glove on its palm or gripping side that extends across the glove palm portion longitudinally thereof and along and between the glove finger portions and wrist portion on the palm side of same, and has a protuberant rib extending crosswise of the strapping and the finger portions adjacent the area of the first finger joints of the finger portions, which rib in use provides a finger controlled over center type socket forming purchase on the handle, and a wrist strapping anchored to the glove palm side strapping adjacent the glove wrist portion at the palm side of same, and at one end of the wrist strapping, with the wrist strapping being proportioned to be wrapped firmly around the glove wrist portion when the water skier applies the glove to his hand, and with the other end of the wrist strapping and the glove including self adhering means for holding the glove wrist strapping in place while the skier is using the glove.

14 Claims, 10 Drawing Figures

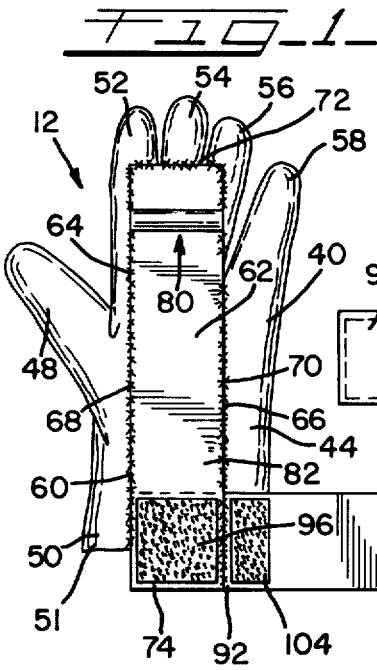
FIG. 1
12
52
54
56
72
58
64
80
62
40
48
70
68
66
44
82
60
50
51
74
92
104
90
96
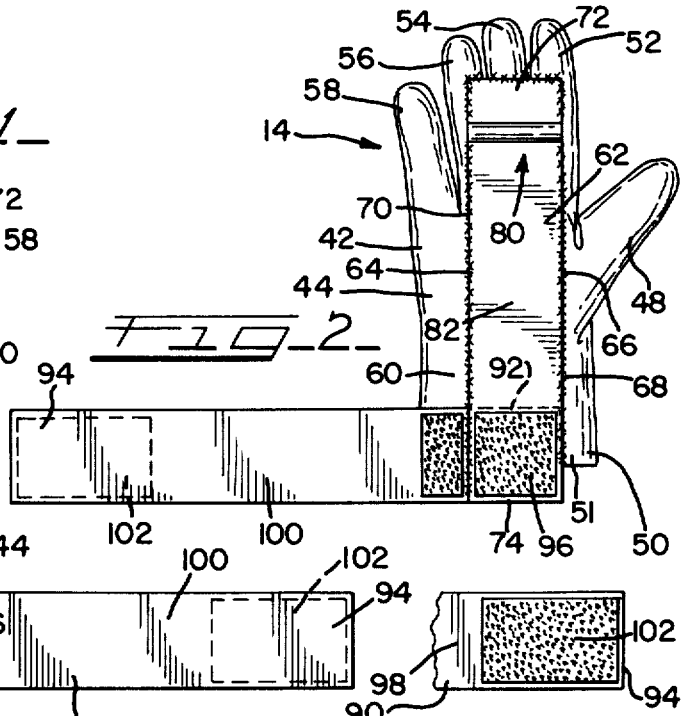
FIG. 2
54
72
52
56
58
14
62
70
80
42
64
44
48
82
66
60
92
68
94
102
100
51
74
96
50
98
90
FIG. 1A
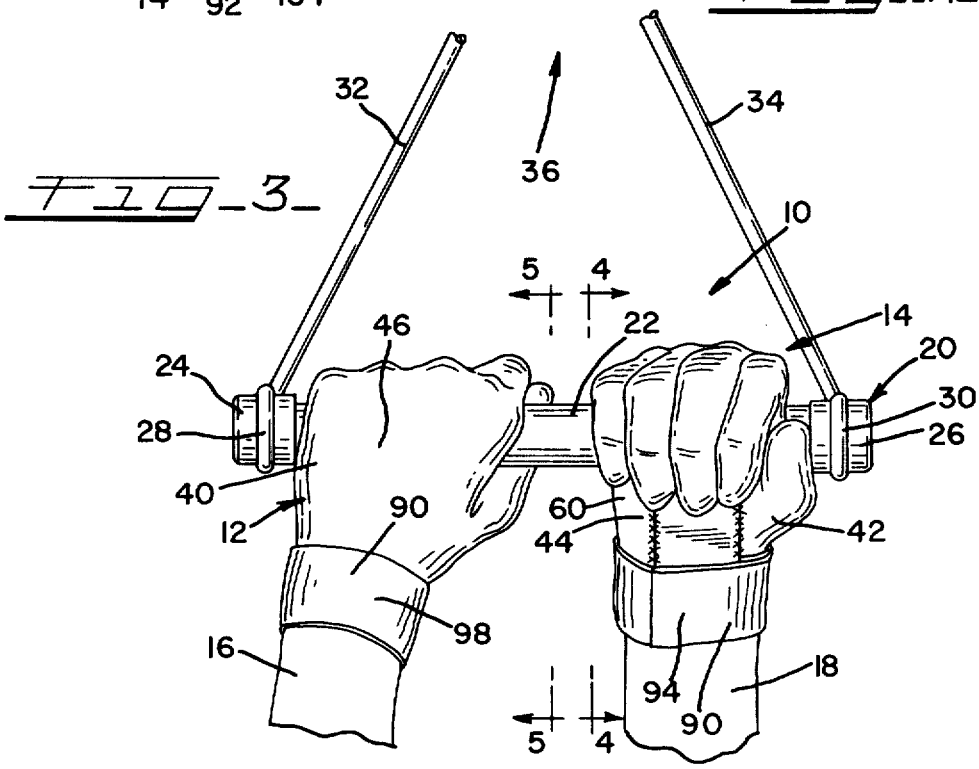
FIG. 3
32
34
36
10
5
4
46
22
14
24
20
30
28
26
40
12
90
60
44
42
98
16
94
18
90
5
4

FIG. 4
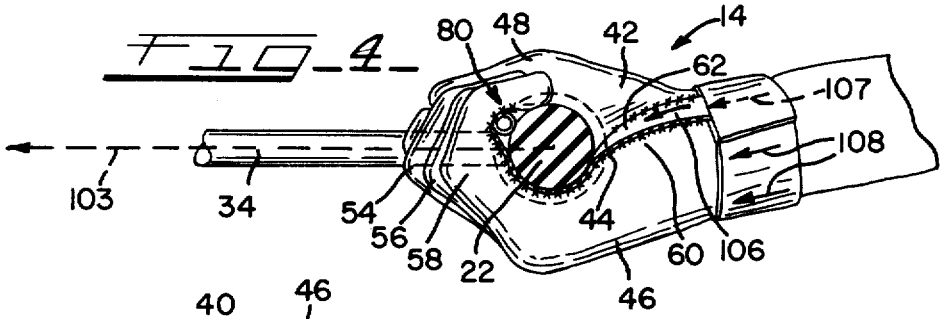
FIG. 5
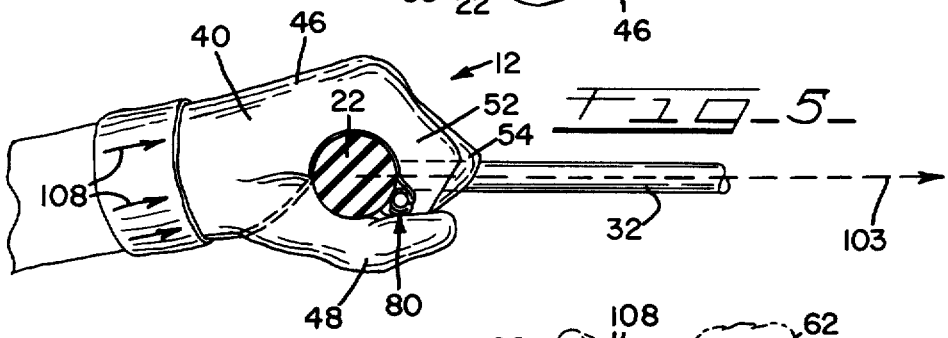
FIG. 7
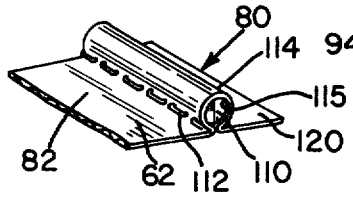
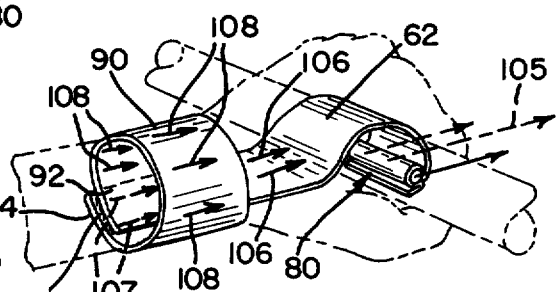
FIG. 6
FIG. 8
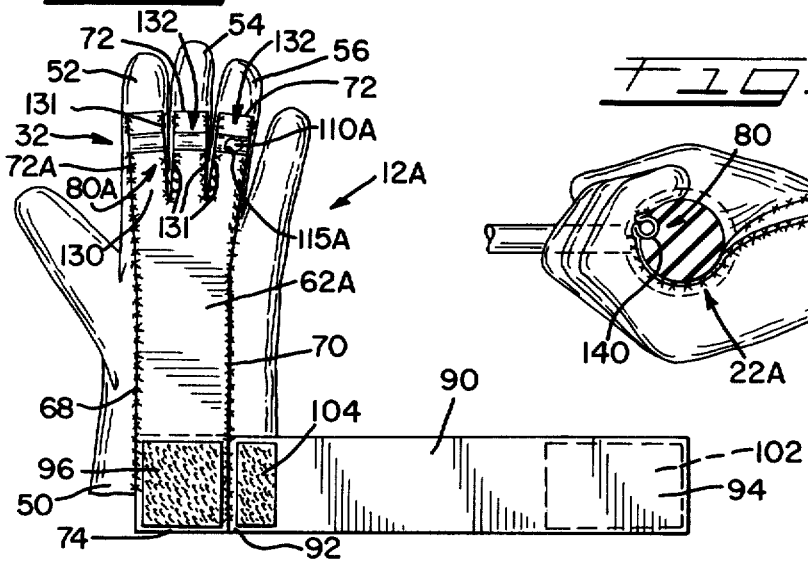
FIG. 9
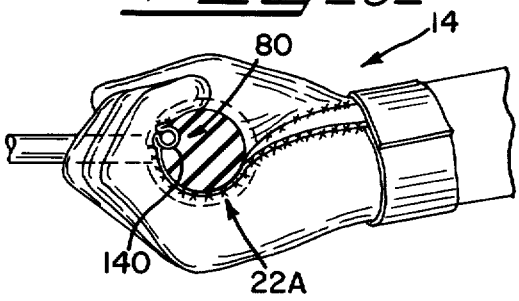

GLOVE ARRANGEMENT FOR WATER SKIING

This invention relates to a glove arrangement for water skiing, and more particularly, to a water ski glove that is arranged to give the water skier a hand hold on the familiar water ski tow rop crossbar handle that avoids fatigue in the skier's hands and forearms, loss of grip of the handle in high pull out situations, and the hand callousing problems that are commonly experienced by those who actively pursue the sport.

The sport of water skiing, which continues to become increasingly popular for both the once in a while participant, and the advanced skier, in being performed involves the use of a suitable speedboat (for instance a powered inboard or outboard) that is equipped with a suitable water ski tow rope mount, and a tow rope of appropriate length equipped at its trailing end with a crossbar type handle which the water skier in practicing the sport grasps with his hands to be pulled by the power boat over the surface of a body of water, preferably under calm conditions, so that the skier, who is equipped with either pair of water skies, or is equipped with a single Slalom ski, can ski behind the boat under the pulling action of the tow rope. The ability and experience of the skier, of course, have a lot to do with the type of skiing activity the skier does or performs, and this may range from the beginner endeavoring to stand up and ride on a pair of skies, to the professional who slaloms, barefoots, jumps, etc. competitively and/or teaches such activites.

A common problem to water skiers regardless of their experience and regularity of participation in the sport is the muscle fatigue that water skiers experience in their hands and forearms, due to the water skier having to hand grip the tow rope crossbar type handle and hang on against the pulling forces being transmitted to his hands and arms through his fingers and hands, with the muscles of the hands and forearms being highly stressed under the pulling action involved, both by the need to tightly hang on to the handle crossbars to prevent its release, and take advantage of the pulling thrusts being applied to the water skier so that the skier can utilize same to move as desired across the water. Should the skier engage in such more advanced water skiing activities as barefooting, jumping, Slalom course traversing, trick skiing, and the like, the stress on the skier's hands cannot only be excessively fatiguing, but the loss of the handle (handle snaps) frequently results in a sudden sometimes embarrassing and always exasperating, termination of a good performance. Furthermore, those who ski regularly heretofore have developed calloused hands, with the problem oftentimes having been so acute that taping of the hands is practiced to try to minimize the problem.

A principal object of this invention is to provide a device whereby the water skier can establish through his hand grip on the tow rope crossbar handle a structural purchase and force transmitting connection to his wrists that permits the pulling thrust of the tow crossbar handle to be applied to the skeletal structure of the skier's arms by way of his wrists in bypassing relation to the muscles of his hands and forearms, whereby muscle fatigue in the skier's hands and forearms is avoided.

Another principal object of the invention is to provide by way of a glove construction that is specifically arranged for water skiers, which permits the water skier, by merely appropriately positioning his fingers relative to the tow rope crossbar handle, to establish a firm stress avoiding structural purchase between himself and the crossbar handle that is effectively and simply maintained while a water ski run the skier is experiencing progresses, and regardless of whether the skier is simply being pulled along the water beginner fashion on two skies, or is performing more advanced activities such as Slalom course traverse, jumping, barefoot, and the like, which purchase is effectively released in the same manner at the skier's option.

Another important object of the invention is to provide by way of a water ski glove arrangement an implement for the water skier to effectively couple himself to the tow rope crossbar handle that avoids the common water skier hand callousing problem, and not by way of providing a cover for the skier's hands, but rather by way of preventing the skier to establish a structural purchase between the tow rope crossbar handle and the skeletal structure of the skier's arms, that is readily and safely maintained as desired or needed, and released on the same basis by the skier appropriately positioning his fingers relative to the tow rope crossbar handle.

In accordance with the invention, a pair of gloves is provided for use by the water skier, of which the respective gloves are similarly arranged in right and left hand manner, with each glove being in the form of a hand cover that includes a palm portion, a back portion, finger portions, a thumb portion, and a wrist portion at the base of the glove. The glove is affixed, to the palm side of same, a palm side strapping that extends across the glove palm portion and along and between the glove wrist portion on the palm side of same and the glove fingers, again on the palm side of same, which palm side strapping has a protuberant rectilinear rib extending crosswise of same and of the glove finger portions, adjacent the area of the first finger joints of the finger portions, and specifically just below the first joint of the index finger when the glove is properly fitted on the wearer's hand. Anchored to the glove palm side strapping adjacent the glove wrist portion at the palm side of the glove, is a thrust transmitting wrist strapping, which has one end of same anchored to the glove palm side strapping; the wrist strapping is proportioned so that, when the glove is applied to the user's hand, the wrist strapping may be firmly wrapped around the glove wrist portion and the wearer's wrists, and the other end of the wrist strapping and the glove are provided with a suitable self gripping or adhering fabric stripping, which is preferably of the hook and loop arrangement type, for securely anchoring the wrist strapping other end in place.

The water skier before skiing applies a pair of such gloves to his hands in the usual manner for a hand glove, with the arrangement being such that, as indicated, when the gloves are properly fitted to the skier and the skier's hands are fully received in same, the indicated rib is located just below the first joint of the skier's index finger on each hand. With the glove so fitted, and the wrist strappings of each glove firmly wrapped about the wrist portions of the respective gloves and anchored in place, the water skier in grasping the tow rope handle crossbar in the usual manner, which is by way of arcing his gloved fingers about the hand on one side of same and applying his thumbs on the other side of same, an over center type hand hold purchase on the tow rope crossbar handle it is established which is maintained by the water skier merely continuing to hold his fingers arced about the handle crossbar he is grasping, but free of also having to hang onto the crossbar against the pull of the tow rope. During the water ski run under the pulling action of the power boat involved, the pulling thrusts of the tow rope are applied to the crossbar and thence to the glove rib of each hand of the skier, and through the palm side and wrist strapping of the skier's gloves to the skier's wrists and arm skeletal structure to the exclusion of the muscles of his hands and forearms.

On the other hand, release of the indicated purchase is effected by the water skier merely straightening out his fingers to release the over center type hand hold purchase he has had on the tow rope handle crossbar, which effects immediate release of the tow rope handle.

Other objects, uses, and advantages will be obvious or become apparent from a consideration of the following detailed description and the application drawings, in which like reference numerals indicate like drawings throughout the several views.

In the drawings:

FIGS. 1 and 2 are, respectively, top plan views of a pair of water ski gloves arranged in accordance with the invention, taken from the palm side of same, with FIG. 1 illustrating the left hand glove and FIG. 2 illustrating the right hand glove;

FIG. 1A is a fragmental bottom plan view illustrating the free end portion of the glove wrist strapping of FIG. 1;

FIG. 3 diagrammatically illustrates in a top plan view the manner in which water skiers commonly grip a common form of water ski tow rope crossbar handle, with the water skier's hands in question having the gloves of FIGS. 1 and 2 applied thereto in accordance with the invention;

FIG. 4 is a diagrammatic sectional view taken substantially along line 4—4 of FIG. 3;

FIG. 5 is a diagrammatic sectional view taken substantially along line 5—5 of FIG. 3;

FIG. 6 is a diagrammatic perspective view illustrating the basic functioning of the applicant's glove strapping and rib therefor in serving as a structural purchase with the tow rope handle crossbar and pulling force transmitting medium being the glove strapping to the water skier's wrist and thus his arm skeletal structure;

FIG. 7 is a fragmental perspective view on an enlarged scale illustrating the glove palm side strapping that is at the finger portions of the glove, and suggesting the details of one form of rib forming arrangement therefor;

FIG. 8 is a view similar to that of FIG. 1 illustrating a modified form of the invention; and FIG. 9 is a view similar to that of FIG. 4 illustrating a further modification of the invention.

However, it is to be distinctly understood that the specific drawing illustrations that are provided have been supplied primarily to comply with the requirements of the Patent Laws, and that the invention is susceptible of modifications and variations that will be obvious to those skilled in the art, and which are intended to be covered by the appended claims.

GENERAL DESCRIPTION

The sport of water skiing has become widely known, and especially to those who frequent lake oriented and situated resorts, summer homes, camps, and the like. While water skiing is, generally speaking, an individualistic sport, in order to perform water skiing the individual requires to have available a power speed boat, such as a Chris Craft, Starcraft, or a Century, insofar as power boats are concerned, or one of the many available so-called outboard power boat models available which have a requisite horsepower to bring the water skier to his feet in the water and pull him about the waters of the lake or the like. The power boat employed has to be suitably equipped with a conventional type of tow rope mount, the leading end of which is connected thereto, and the trailing end of same is commonly bifurcated at its end portion to define a pair of forked end portions that are made fast to opposite ends of the familiar crossbar type handle that is grasped by the water skier. The power boat is ordinarily operated by the boat driver, and common safety regulations require that the boat also include at least one observer to watch the water skier and act as the go between between the water skier and the driver, depending on the needs of the particular water ski run being experienced.

To start the run, the water skier equips himself with a pair of water skis, and in an appropriate start position at dock side, after applying the usual life preserver, grasps a tow rope crossbar type handle. The water skier may be at rest in an appropriate postion in the water awaiting pull up by the power boat when it starts, or he may be standing on a pier or dock for a so-called jump start when the power boat gets under way. In any event, the forward movement of the boat as it accelerates and comes up to speed brings the water skier in water skiing position on the water in which he is leaning rearwardly and his skies may be inclined upwardly somewhat, against the water in a forward direction, as the pulling thrusts of the tow rope handle are applied to the water skier's body to move him through the water. Where the water skier is a beginner or novice, the ski run involved ordinarily is concerned with pulling the water skier behind the boat's wake at a relatively slow speed. More advanced skiers will ride the wake on either side of the boat at twenty miles per hour or more, and eventually learn to operate the well-known Slalom ski.

Expert skiers, on the other hand, will have learned the various water ski skills that are concerned with such things as barefooting (which involves no skies at all), Slalom course traversing for fun and competition, which involves a single specially built ski on which the water skier balances in performing his movements, and jumping, which involves the use of two skies for jumping off an elevated ramp, not to mention trick skiing of various types, and the like. In most instances, the water skier receives his forward movement thrust by hand gripping the conventional and standard tow rope crossbar handle. Thus, the coupling that the water skier makes at the tow rope crossbar handle is critical and, except for some special water ski performances, where, for instance, the tow rope handle may be held between the skier's legs, all encompassing to water ski sport participants, and this is what the present invention is directed to.

Referring now specifically to the drawings, reference numeral 10 of FIG. 3 indicates a pair of water ski gloves 12 and 14 that are arranged in accordance with the present invention, and that have been applied respectively to the left and right arms 16 and 18 of a water skier, and specifically to the hands of the water skier's said arms (which hands are not specifically shown as they are covered by the gloves 12 and 14, respectively). The water skier with the pair of gloves 10 applied to his hands, in getting set for this water ski run, and during his water ski run, grasps the rope tow crossbar handle 20 in the familiar water ski handle grip manner indicated in FIG. 3, where one hand is shown applied over the top of the handle 20 and the other hand is shown applied under the underside of the handle 20. In another common gripping manner, both hands are applied over the top of the handle, but this is immaterial to the practice of the present invention.

Conventional crossbar handles 20, of which one familiar form is illustrated, comprises crossbar 22 that may be covered with a hard foam rubber, or may be a simple rigid plastic tube, or a solid wooden bar, to the ends of which are applied suitable caps 24 and 26 that have apertures aligned with apertures in the handle bar ends for tying application of the ends 28 and 30 of the respective terminal portions 32 and 34 of tow rope 36 which merge in a conventional manner with the main tow rope body (not shown) that is suitably connected to the power boat being employed.

In accordance with the present invention, the gloves 12 and 14 may comprise suitable hand covers 40 and 42, which are of the same construction except, of course, they are for the skier's left and right hands respectively; each comprises a palm portion 44, a back portion 46, thumb portion 48, wrist portion 50 which in effect forms the skirt 51 of the respective gloves and extends about the palm and back sides of the gloves as well as the glove marginal sides in the area of the wrist portion, as is conventional with most gloves that extend over the wearer's wrists.

The hand covers 40 and 42 also include the usual multiple finger portions 52, 54, 56, and 58, in which the user's index fingers, middle finger, ring finger, and little finger, are respectively received when the gloves have been put on by the user.

Of course, hand covers 40 and 42 are to be available in different sizes as required to properly fit the user's hands with close fitting gloves, which will depend on the size of the wearer's hands. The hand cover 40 provided by the glove 12 and the hand cover 42 provided by the glove 14 are proportioned to closely fit the user's hands and have the wrist portion 50 extend well beyond the user's wrists appropriately for the practice of the invention, which may be on the order of one to two inches.

The hand covers 40 and 42, as such, may be made in any conventional manner from any suitable flexible fabric materials or their equivalent, of suitable non-shrinking, and wear and deterioration resistant characteristics.

In accordance with the invention, the gloves 12 and 14 each have applied to the palm side 60 of same a length of palm side strapping 62, that may be in the form of nylon or canvas webbing or the like, which extends lengthwise of the palm side 16 of the glove and more or less in parallelism to the finger portions of the glove hand covers 40 and 42 (when same are laid out flat, as viewed in FIGS. 1 and 2), from the glove cover finger portion to and across the glove cover wrist portion 50. The strapping 62 is secured to the glove by suitable stitching, such as stitching 64 and 66 applied along its respective side edges 68 and 70, respectively, that extend between its ends 72 and 74. Adjacent the ends 72 the strapping 62 is formed to define protuberant rectilinear rib 80 that, as indicated by FIGS. 1, 2 and 7, is upstanding with regard to the top or exposed side 82 of strapping 62. Rib 80 is oriented to extend substantially transversely of the strapping 62 and crosswise of the glove finger portions, and for best results the water skier when properly fitted with the gloves 12 and 14 finds the rib 80 just below the first joint of his index finger, which would thus be just below the first index finger joint location of the finger portion 52 of the gloves 12 and 14.

Further in accordance with the invention, the respective gloves 12 and 14 each include a wrist strapping 90 that may be formed from the same materials as strapping 62 and has its end 92 anchored to the end 74 of strapping 62 as by employing suitable stitching; in the illustrated embodiments, the end 92 of the wrist strapping 90 underlies the end 74 of the palm side strapping 62, and these two parts are stitched together and to the cover that forms the respective gloves 12 and 14.

The wrist strapping 92, in accordance with the invention is proportioned in length so that it may be wrapped firmly about the user's forearm adjacent his wrist, when the glove is applied to the user's hands, and about the glove wrist portion 50, so that its end 94 may be brought around his wrist and applied in overlying relation to the end 74 of the palm side strapping 62.

Further in accordance with the invention, the strapping end 74 has applied to the top or exposed side 82 of strapping 74, as by employing a suitable adhesive or stitching, or both, a strapping component 96, while the back side 98 of the wrist strapping 90, as distinguished from its front side 100, has a similar strapping component 102 applied thereto in the same manner, and thus as by employing a suitable adhesive. The stripping components 96 and 102 preferably are in the form of the self gripping nylon product of the hook and loop system that is made by American Velcro Corportion sold under the trademark VELCRO. In the embodiments illustrated, the stripping 96 has the loop section of the Velcro product while the stripping 102 is the hook section of the Velcro products, but, of course, the positioning of these components can be reversed. In the embodiments illustrated, the front side 100 of the wrist strapping 90 also has a short section 104 of stripping that is comparable to the stripping 96, for locking relation with the stripping 102 in the event that for a particular application of the gloves 12 and 14 the end 94 of strapping 90 should substantially overlap the stripping 96. Similarly, the stripping 102 may be extended toward the end 92 of the strapping 90 as may seem to be necessary or desirable.

In use, as already indicated, the water skier in preparing to water ski applies a pair of gloves 10 to his hands, which, of course, involves slipping his left hand into the glove 12 and his right hand into the glove 14 in the usual manner for close fitting gloves, so that the user's fingers and thumb are fully received in the finger and thumb portions of the respective gloves and the glove wrist portions 50 extend below the wrists, respectively, of the user an amount in the range indicated.

In this connection, the gloves 12 and 14 may be supplied, for instance, in small, medium, and large sizes to accommodate the various sizes of hands of water ski participants to be fitted, although, of course, the gloves can be specially fitted to any particular person as needed. In any event, it is desirable that the protuberant ridge for properly fitted gloves 12 and 14 be disposed adjacent to and just below the first joint of the user's index finger, and thus adjacent to and below the corresponding joint area of the glove index finger portions 52.

As the individual gloves 12 and 14 are applied, part of the glove application involves the user grasping the end 94 of wrist strapping 90, pulling it around the back of his wrist and around and over the top of the stripping 96 (or stripping 96 and 104 as the case may be), while pulling the strapping 90 from its end 94 in firm binding relation with one's wrist, and pressing the strippings 102 and 96 (or 96 and 104) into firm interengaging and locking relation, that is characteristic of the Velcro product described.

Both gloves 12 and 14 are applied in this manner, with the strappings 90 of gloves 12 and 14 being handled in the right hand and left hand manner in effecting the connection of wrist strapping end 94 to palm side strapping end 74.

The user now has the gloves 12 and 14 applied thereto so that his hands are covered as indicated in FIGS. 3, 4 and 5.

Assuming that the user is ready to water ski, as by having applied his water skis and life preserver, and is ready to make his water ski run, the user grasps a tow rope handle bar in one of the normal grip manners that have been indicated, for instance the normal grip manner indicated in FIG. 3. As indicated in FIG. 3, this may involve the gloved fingers of the left hand being arced over the bar 22 from one side thereof and the gloved fingers of the right hand being arced over the handle 22 from the other side there, or vice versa, depending on the fit that seems appropriate to the user. Also, the finger gloves of both hands may be arced over the same side of the handle 22. In any event, the user's thumbs are comfortably disposed in opposed, normal gripping relation to the gloved fingers of the respective hands of the user.

In any event, as indicated in FIGS. 4, 5 and 6, the water skier in arcing his fingers over against the handle bar 22, in normal bar hand gripping relation thereto disposes the rib 80 of the respective gloves 12 and 14 in an over center position relative to side of the bar 22 from which the gloved fingers are applied, and the position of the water skier holding the rope tow handle bar 32. As long as the water skier maintains his gloved fingers in this arced manner, the rib 80 remains in this over centered position; since rib 80 is fixedly connected to the palm side strapping 62, and wrist strapping 90 is fixed to the end 74 of strapping 62 and is firmly applied about the water skier's wrists insofar as the respective gloves 12 and 14 are concerned, a structural purchase is established by the rib 80 in association with the handle cross bar 22, which purchase includes the strappings 62 and 90, whereby, when the power boats pulling forces are applied to tow rope 36, the handle bar 22 is socketed behind the rib 80 as long as the water skier maintains his fingers in the arced position illustrated in FIGS. 3-5 and the pull forces are thus transmitted to and through strapping 62 to the strapping 90, and thence to the water skier's wrists, of his respective hands, with the forces being diagrammatically illustrated by the arrows shown in FIGS. 4, 5 and 6.

Thus, the basic pulling forces applied to the crossbar handle 22, represented by arrow 105, are subdivided for each of the skier's hands, as indicated by reference numeral 105 of FIG. 6, and are transmitted to the rib 80, and these subdivided pull forces are transmitted through rib 80 to palm side strapping 62, as represented by arrows 106, which transmits such pulling forces to the wrist strapping 90 at its end 42 as represented by arrows 107, which distributes such pulling forces about the skier's wrists, as represented by arrows 108.

In this connection, the water skier's hand in the showing of FIG. 6 is shown in outline only, as is the handle bar 22, to better illustrate the cooperating nature of the rib 80, the strapping 62, and the strapping 90 (the glove 12 in the showing of FIG. 6 also being assumed to be part of the outline that defines the user's hand in the showing of FIG. 6).

The result is that the pull forces applied to the handle crossbar 22 and thence to the rib 80 and strappings 62 and 90, of the respective gloves 12 and 14, are applied to the skeletal structure of the water skier's arms, by way of application to and about his wrists, in bypassing relation to the muscles of the water skier's hands and forearms. This is to be distinguished from conventional practices whereby a water skier not having the benefit of the applicant's invention has to use the muscles of his hands and forearms to strongly grasp the handle bar 22 to avoid the handle bar being pulled from his grasp as well as to provide the coupling whereby the pull forces of the tow rope are transmitted to the water skier through his hands, which thus must be maintained in a vice like gripping relation with the handle bar 22.

The tow rope pulling action that is applied to a water skier by the practice of the invention, through the structural purchase represented by the applicant's thrust connection equipped gloves 12 and 14 is maintained, against the pulling action of the tow rope, so long as the water skier maintains his gloved fingers in the arced relation of FIGS. 3-6. For this purpose no great amount of hand gripping pressure needs to be applied to the handle crossbar 22 as it is only necessary that the protuberant rib 80 be maintained in the over centered position indicated in FIGS. 4 and 5 to keep the handle 22 in the socketed relation there illustrated relative to the rib 80 and the water skier's arced fingers.

On the other hand, when a water skier desires to release the handle crossbar 22, it is only necessary for the water skier to straighten out his fingers so that the rib 80 loses its over centered position relative to the bar 22 and the bar 22 pulls or drops free of the water skier's hands.

The result is that when the water skier is using the gloves of this invention for his water ski run, muscle fatigue in his hands and forearms is eliminated, thereby overcoming the discouraging early tiring problem that the recreational and occasional water skier have heretofor had, and correspondingly relieving debilitating muscle fatigue for the advanced and competitive water skier.

Furthermore, the socketed relation that the handle crossbar 22 has with respect to the rib 80 and the user's fingers when the water skier is grasping the handle bar 22, and the transmittal of the pulling forces involved, to the water skier's skeletal arm structure about his wrists, instead of through his fingers and hands eliminates the problem of high stress application to the water skier's hands and loss of grip on the tow rope handle (handle snaps) that can occur unexpectedly in high pull situations. This is a significant benefit to the advanced and competitive water skier.

Moreover, the practice of the invention eliminates the problem of calloused hands since the abrasion effect on the hands is practically eliminated, not because the hands are gloved, but because the force transmittal from the tow rope handle bar 22 is via the rib 80 and strappings 62 and 90 to the water skier's arm skeletal structure by application of same, in bypassed relation to the user's hands, namely his fingers, palm, and thumb.

SPECIFIC DESCRIPTION

As indicated, the covers 40 and 42 of the respective gloves 12 and 14 may be of any suitable type and material. While the multiple and full finger glove configuration illustrated is preferred for sports such as water skiing, the glove employed could also be of the type in which a single finger portion receives all fingers of the user's hand, so long as the rib 80 is located as indicated with respect to the first joint of the index finger.

The strappings 62 and 90 may be of any suitable type, such as the nylon or canvas webbing suggested; water resistant leather and plastic strapping of suitable tension strength and flexibility would also be satisfactory.

In the embodiments of FIGS. 1–7, the palm side strapping 62 is proportioned width wise to be affixed to the finger portions 52, 54 and 56 of the respective gloves. While the strapping 62 can be proportioned to be affixed to all four finger portions including the finger portion 58, this involves additional material that is not ordinarily necessary since the rib 80 as provided by the strapping 62 having the proportioning indicated very well serves the purpose.

The rib 80 as a general rule may be formed in any suitable manner, FIG. 7 illustrating one embodiment in which a plastic dowel 110 forms the core or the rib, with the strapping 62 being tucked or looped to define pocket 115 in which dowel 110 is disposed in close fitting relation thereto and the strapping 62 stitched in place thereabout where indicated at 112 in such a manner such that the dowel 110 is tightly held within the 114. In this arrangement the dowel 110 is continuous in length for the width of the strapping 62 and in the embodiment illustrated, the rib 80 including dowel 110 has a cross-sectional diameter approximating one centimeter in dimension. Ribs 80 on the order of this size will be found to fully serve the purposes described herein.

The strippings 96, 102 and 104 are of the familiar Velcro product type hook and loop system fabric construction. An adhesive suitable for affixing the strippings 96, 102 and 104 in place is Barge all purpose cement available at Barge Cement Division, Pierce & Stevens Chemical Corp. of Buffalo, N.Y.

The rib 80 as a matter of practice may be formed in any manner that will provide the protuberant or projecting, ridge or rib like, rectilinear configuration illustrated, which, of course, should be located with the orientation relative to the strapping 62 and index finger first joint that has been specified and should be relatively firm or at least semi-rigid in nature, as distinguished from being soft and pliable. The dowel 110 is preferably formed from a hard or rigid plastic or metallic material that may be resilient, but should be corrosion free or resistant because of the water related use to which the invention is to be put. Thus, the dowel 110 may be formed from hard wood, a suitable rubber compound or a suitable plastic, such as ABS or a polyurethane or polyethylene. The pocket 115 in which the dowel 110 is received should be in close fitting relation to the dowel, and of course a suitable adhesive may be employed to bond the dowel in place. Pocket 115 can be formed by the strapping in any suitable manner, such as the loop or tuck 114 that is illustrated which, of course, could involve the terminal end 120 of the strapping end 72 being turned underneath the strap 62 or cut off entirely so long as the pocket 115 securely holds the dowel 110.

In the glove arrangement of FIGS. 1–7 the end 92 of the strapping 90 is affixed to the glove under the end 74 of the strapping 62 (in the positioning shown in FIGS. 1 and 2, but, of course, this relation of parts could be reversed as desired, with the stripping 96 then being applied on the top surface 100 of the strapping 90.

In the pair of gloves 10 illustrated, the wrist strappings 90 project from the little finger side of the glove, and this arrangement is preferred because it is easy for the water skier to manipulate the strapping 90 by winding it around his wrists first outwardly from the palm side of same around the back of the wrist and then over against the stripping 96 or 96 and 104 at the front or palm side of the wrist. However, the strappings 90 could be applied so as to extend from the thumb sides of the gloves, in which case the wrapping of the strapping 90 about the individual's wrists would be reversed.

In the glove 12A shown in FIG. 8, the strapping 62A at its end 72A is subdivided in alignment with the respective glove finger portions 52, 54 and 56 to define strapping sections 130 that are shaped as shown in FIG. 7 to define a pocket 115A housing a dowel section 110A, with the pockets 115A and dowel sections 110A having a length in proportion to the width of the respective sections 130. The strapping sections 130 are each individually stitched to the respective finger portions 52, 54 and 56, as at 131, in addition to the stitching 68, 70 and 72 so as to firmly anchor them to the glove finger portions in question, and when the water skier wears the gloves 12A, the resulting rib 80A will be made up of the aligned rib sections 132, whereby the rib 80A will be disposed with the same orientation relative to the glove 12A that rib 80 has with respect to the glove 12. Of course, glove 12A will have a right hand glove mate arranged in the same manner so that the water skier will have a pair of gloves comparable to glove 12A to wear for water skiing purposes, with the same results being provided as have been hereindescribed before.

The remaining components of the glove 12A are the same as previously described, as indicated by corresponding reference numerals.

In the embodiment of FIG. 9, the glove 14 of FIGS. 1–7 is shown being used in conjunction with a modified tow rope handle bar 22A, which in accordance with the invention is formed with recess 140 in which the rib 80 (or 80A) is lodged when the water skier grasps the tow rope handle for water skiing purposes. The recess 140 is concave in shape and roughly semicylindrical to conform to the configuration of the rib 80 (or 80A) in roughly complementary relation thereto. In carrying out this version of the invention, the tow rope handle cross bar 22A requires a second recess 140 located on the left hand side of same approximately where indicated by the presence of the rib 80 in FIG. 5 so that the water skier's left hand rib 80 is socketed into such second recess.

It will be apparent that in the embodiment of the invention illustrated by FIG. 9, in addition to the over centered positioning of the ribs 80 (or 80A) of the water skier's gloves, an added purchase securement to the modified cross bar 22A is provided by reason of the lodging of the respective ribs 80 (or 80A) in the indicated recesses 140.

Of course, where the water skier prefers to grasp the handle bar 22A with both hands over the same side of the crossbar 22A, then the recess 140 could extend the full length of the area of the crossbar 220A, longitudinally thereof, that would be gripped by the water skier.

It will also be apparent that the tow rope handle crossbar 22A may have the recesses 140 extending the length of same for both the locations shown in FIG. 9 and suggested by FIG. 5, to accommodate both manners of gripping the tow rope handle crossbar.

It will therefore be seen that the invention provides a water ski tow rope handle crossbar gripping implement whereby the water skier establishes a structural purchase between the water skiing tow rope cross handle bar and skeletal structure of the skier's arms, by way of a coupling in which the water skier, by merely holding his fingers in the normal arced positioning lightly engaging the cross bar in question, to dispose the glove ribs in the over centered positions illustrated in the drawings, with the pull thrust forces involved being transmitted through the glove palm side and wrist strappings and to the skeletal structure of the water skier's arms, about his wrists, in bypassing relation to the water skier's hand and forearm muscles.

The result is that fatigue in the water skier's hands and forearms is eliminated, as is the heretofore ever present problem of handle snaps in high pull situations and the problem of having to provide taping or the like to avoid calloused hands.

On the other hand, when the water skier wishes to release the tow rope handle he merely straightens out his fingers relative to the handle crossbar, and of course this can be instantly done by merely appropriately flexing his fingers, with the result that the coupling involved is automatically and completely released. This is important when the skier falls or senses he should immediately discontinue his run.

The difference between skiing employing a conventional hand gripping of the water ski handle crossbar (for instance, without any gloves, or in any event gloves that are free of the strapping 62 and 90, and the ribs 80 and 80A of this invention, and, for instance, skiing with the same tow rope handle employing gloves 12 and 14 will be abundantly apparent in making the following test.

On the ground, a length of tow rope bearing a handle bar 22 has the other end of the rope tied to a fixed object that will not move, such as a tree. The individual then grasping the crossbar handle 22 with his bare hands and pulling with all his weight will find that the harder one pulls the more tension the individual feels in his hands and forearms. When, for instance, a pair 60 of gloves 12 and 14 are applied to the individual's hands in the manner illustrated in the drawings, and the individual pulls with all his weight on the tow rope, it will be found that all of the pull is applied to and about his wrists through the wrist strappings 90; if the individual relaxes his hand while maintaining the positioning shown in FIGS. 4 and 5 relative to the handle crossbar 22, the individual will find that he can still effortlessly hold onto the handle bar 22. But by straightening his fingers, the coupling between the individual's gloved hands and the tow rope crossbar handle separates and the handle will freely release from the hands.

The foregoing description and the drawings are given merely to explain and illustrate the invention, and the invention is not to be limited thereto, except insofar as the appended claims are so limited, since those skilled in the art who have the disclosure before them will be able to make modifications and variations therein without departing from the scope of the invention.

I claim:

1. In a water ski glove for application to the hand of a water skier that provides a hand cover including a palm portion, a finger portion, a thumb portion, and a wrist portion each including a palm side and back side, the improvement wherein:

said glove has fixed thereto and extending between said glove finger portion and said wrist portion on said palm side thereof a palm side strapping that extends longitudinally of the glove, said palm side strapping having a protuberant rib extending crosswise of the glove palm side and transversely of the glove finger portion, said rib being located adjacent the first finger joint area of the glove finger portion, said rib projecting outwardly of said palm side strapping, a wrist strapping anchored to the wrist end of said palm side strapping, and means for securing said wrist strapping in close fitting relation about the glove wrist portion when the water skier has inserted his hand in the glove.

2. The improvement set forth in claim 1 wherein:

said wrist strapping is affixed at one end thereof to said wrist end of said palm side strapping in substantially normal relation thereto, said securing means comprising said wrist strapping having a wrapping length portion integral with said one end thereof that extends to adjacent the other end thereof and that is proportioned lengthwise thereof to be manually wrapped from said one end thereof about the back side of the glove wrist portion to the palm side of the glove in close fitting wrapped relation about the glove wrist portion, and releasable self adhering means for manually adhering said wrist strapping other end to the glove to maintain said wrist strapping in said close fitting wrapped relation.

3. The improvement set forth in claim 2 wherein:

said rib is located on the glove immediately below the level of the glove index finger first joint.

4. The improvement set forth in claim 3 wherein:

said rib has transverse cross-sectional dimension approximating one centimeter.

5. The improvement set forth in claim 4 wherein:

said rib comprises rigid dowel means with said palm side strapping being fastened about said dowel means in secured relation to the glove finger portion to anchor said dowel means to the glove.

6. In use in the sport of water skiing wherein the water skier hand grasps the crossbar handle of the water ski tow rope for towing thereby whereby the towing force applied to the water skier by the tow rope handle pulls against the water skier's hands that are in hand gripping relation to the handle with as to each hand of the skier the hand fingers and the hand thumb are applied about opposite sides of the cross handle, a glove for enabling the water skier to establish through his grip on the tow crossbar handle a structural purchase that bypasses his hand muscles, said glove comprising:

a hand cover including a palm portion, a back portion, a thumb portion, finger portions, and a wrist portion, a palm side strapping affixed across said glove and extending longitudinally thereof between at least some of said finger portions and said wrist portion on the palm side of the glove, said palm side strapping having a protuberant rib extending crosswise thereof and transversely of the glove finger portions and being located adjacent the areas of the first finger joints of said some of said glove finger portions, said rib being in protuberant relation to the glove palm side, a wrist strapping anchored to the said palm side strapping adjacent the glove wrist portion at the palm side of same, and means for securing said wrist strapping in close fitting relation about the glove wrist portion when the water skier has inserted his hand in the glove with his hand fingers and thumb respectively received in glove fitting relation to the respective glove finger and thumb portions, whereby to hold the tow rope crossbar handle for water ski towing purposes, the water skier may arc his fingers of his hand bearing said glove over one side of the handle crossbar to lodge said rib behind the cross handle bar in over center relation thereto with respect to the water skier for establishing said purchase for transmittal to the skier's wrist for pulling forces applied by the tow rope handle, with said purchase being disconnected by the skier straightening his fingers to free said rib from said over center relation to the handle crossbar.

7. The water ski glove set forth in claim 6 wherein:

said wrist strapping is affixed at one end thereof to the wrist end of said palm side strapping in substantially normal relation thereto, said securing means comprising said wrist strapping having a wrapping length portion integral with said one end thereof that extends to adjacent the other end thereof and that is proportioned lengthwise thereof to be manually wrapped from said one end thereof about the back side of the glove wrist portion to the palm side of the glove in close fitting wrapped relation about the glove wrist portion, and releasable self adhering means for manually adhering said wrist strapping other end to the glove to maintain said wrist strapping in said close fitting wrapped relation.

8. The water ski glove set forth in claim 7 wherein:

said rib is located on the glove immediately below the level of the index finger first joint of the glove index finger portion.

9. The water ski glove set forth in claim 8 wherein:

said rib has a transverse cross-sectional dimension approximating one centimeter.

10. The water ski glove set forth in claim 7 wherein:

said rib comprises rigid dowel means with said palm side strapping being looped about said dowel means in secured relation to the glove finger portion to anchor said dowel means to the glove.

11. The water ski glove set forth in claim 10 wherein:

said rib is proportioned lengthwise thereof to extend across the index finger, the middle finger, and the ring finger portions of said glove.

12. The water ski glove set forth in claim 11 wherein:

said rib is continuous across said glove index, middle and ring finger portions.

13. The water ski glove set forth in claim 11 wherein:

said rib is segmented in alignment with the glove index, middle and ring finger portions.

14. The water ski glove set forth in claim 6 in combination with the tow rope crossbar handle, wherein said handle is formed with a recess on its surface in which the glove rib may be lodged when said rib is disposed in said over center relation.

* * * * *